United States Patent [19]

Tsukamoto et al.

[11] Patent Number: 4,483,229

[45] Date of Patent: Nov. 20, 1984

[54] ELECTRONIC MUSICAL INSTRUMENT

[75] Inventors: Masao Tsukamoto, Katano; Kinji Kawamoto, Yawata; Masaru Uya, Kadoma, all of Japan

[73] Assignee: Matsushita Electric Industrial Co., Ltd., Kadoma, Japan

[21] Appl. No.: 458,051

[22] Filed: Jan. 14, 1983

Related U.S. Application Data

[63] Continuation of Ser. No. 236,306, Feb. 20, 1981, abandoned.

[30] Foreign Application Priority Data

Feb. 20, 1980 [JP] Japan ..... 55-20734

[51] Int. Cl.[3] ..... G10H 1/00

[52] U.S. Cl. ..... 84/1.01; 84/1.19; 84/1.26

[58] Field of Search ..... 84/1.01, 1.03, 1.26, 84/1.13, 1.19, 1.22

[56] References Cited

U.S. PATENT DOCUMENTS

| | | | |
|---|---|---|---|
| 3,610,805 | 10/1971 | Watson et al. | 84/1.13 |
| 3,844,379 | 10/1974 | Tomisawa et al. | 84/1.26 |
| 4,184,400 | 1/1980 | Mimi | 84/1.03 |
| 4,254,681 | 3/1981 | Kugisawa et al. | 84/1.01 |
| 4,267,763 | 5/1981 | Futamase et al. | 84/1.26 |
| 4,373,416 | 2/1983 | Endo et al. | 84/1.01 |

OTHER PUBLICATIONS

Snell, "Design of a Digital Oscillator which will Generate Up to 256 Low Distortion Sine Waves in Real Time," Computer Music Journal Apr. 1977.

*Primary Examiner*—Forester W. Isen

*Attorney, Agent, or Firm*—Wenderoth, Lind & Ponack

[57] ABSTRACT

A tone source system for a superior electronic musical instrument suitable for an LSI application in which the wave data can be provided in a time division multiplex form, or the envelope data can be provided in a time division multiplex form in a synchronous relationship with it, and the wave data to which the envelopes are attached can be provided in a time division multiplex form through multiplication of the data.

2 Claims, 17 Drawing Figures

Fig. 8
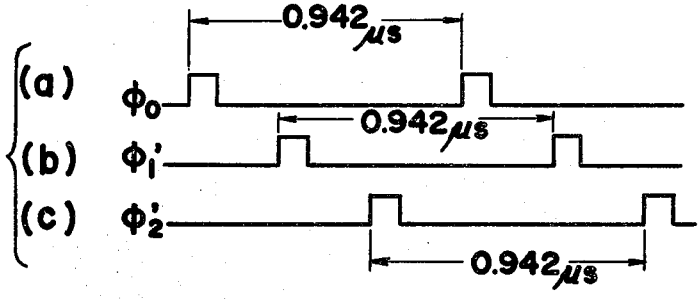
Fig. 9
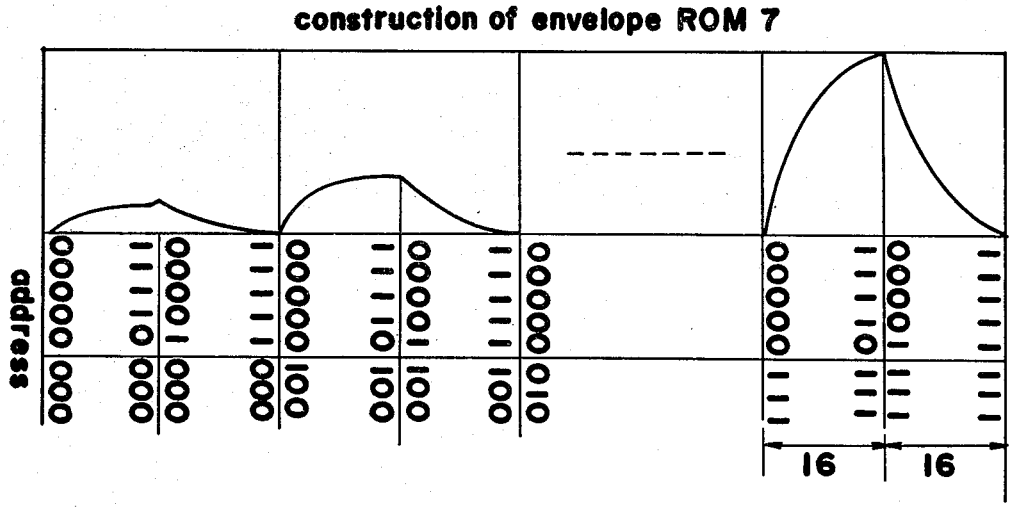
Fig. 10
address of envelope ROM
| D7 | D6 | D5 | D4 | D3 | D2 | D1 | D0 |
|---|---|---|---|---|---|---|---|

ELECTRONIC MUSICAL INSTRUMENT

This application is a continuation of now abandoned application Ser. No. 236,306 filed Feb. 20, 1981.

BACKGROUND OF THE INVENTION

The present invention relates to an electronic musical instrument and, more particularly, to a digital tone generating system suitable for the large scale integrated circuit (hereinafter referred to as an LSI circuit).

Conventionally, many kinds of proposals concerning digital tone source circuits for electronic musical instruments have often been tried. The complex waves including many harmonics have been read in wave data with a given clock from a read only memory (hereinafter referred to as an ROM) or from a random access read/write memory (hereinafter referred to as a RAM) to provide the tone wave. Thereafter, the given envelope has been attached to the tone wave by a digital technique or an analog technique to thereby provide the tone signal.

Some problems which occur in such a case are as follows. As a first problem, a calculation for making the waves has existed. Since to change the tone color, the complex waves are changed in shape within this instrument, when the tone color data are provided at the proportions of each of the harmonics, like the draw-bar most used for the electronic musical instrument, in the order of the level of the 8 feet (fundamental), the level of the 4 feet (second harmonics) and the level of the $2\frac{2}{3}$ feet (third harmonics), the complex wave corresponding in shape to it has to be made from the tone color data. Namely, an inverted fourier transform is required to be performed. Although recently, microcomputers are available at lower cost, the inverted fourier transform requires a computing time of from several hundreds of milliseconds to approximately one second. In addition, the inverted fourier transform is required to be performed every time a player changes drawbars or switches tone tablets. Thus, when more time is required for calculation, the tone color may not change immediately or the tone may not be made for some time. Accordingly, these problems are not suitable for the performance of the musical setting which often requires frequent color-tone switching.

As a second problem, the tone color remains unchanged from the time for the tone to be made to the time for the tone to be disappeared. If the inverted fourier transform is performed from the tone color data and the wave data is provided, the wave data is written in the memory and the wave data of the memory is repeatedly read at a given clock rate, with the result that the wave normally becomes constant. Even if a given envelope is attached to the wave, the tone color remains unchanged. To change the tone color every moment, the memory wave is required to be rewritten every moment. Since the memory itself is normally read, it is required to be written into between the read timings in a synchronous relationship with the read cycle for the rewriting of the memory contents. The read clock is not always constant, since it changes with the produced step, and it is very difficult to rewrite the waves in terms of hardware. As described hereinabove, the tone-color change means a high-speed inverted fourier transform for each moment, since the inverted fourier transform is required to be performed each time from the tone color data to provide the wave data.

Even from this point, it can be apparent that the tone color is extremely difficult to be changed every moment.

As a third problem, there is a problem of the system clock of the whole hardware. The digital circuit is adapted to operate under a fixed clock for an easier synchronous relationship of the whole system, whereby the timing between the logic circuits is rendered definite and the construction of the hardware is rendered simpler. On the other hand, in the tone source circuit of the electronic musical instrument, twelve different clocks are provided to obtain the tone signal of each note of C, C#, D . . . B so as to thereby change the read speed. For instance, to change the octave in the order of $C_1$, $C_2$, $C_3$ . . . , the clock for C note is required to be rendered $\frac{1}{2}$, $\frac{1}{4}$, $\frac{1}{8}$ . . . , or the memory address is required to be read by 2 jumps, 4 jumps, 8 jumps, . . . . However, the clock of the C# note is required to be $2^{1/12}$ times as fast as the clock of the C note. Similarly, the clock of the D note is required to be $2^{1/12}$ times as fast as the clock of the C note. The clock of the D# note is required to be $2^{1/12}$ times as fast as the clock of the C note. Since these $2^{1/12}$, $2^{2/12}$, $2^{3/12}$, . . . are irrational numbers, 12 independent clock generators are required to be disposed to generate these 12 clocks by the hardware. The problem is that a synchronous relationship cannot be provided, and the hardware cannot be commonly used, since the twelve clock speeds are completely independent. Accordingly, since a plurality of envelope multipliers and a plurality of digital-to-analog converters (hereinafter referred to as D/A converters) are required, the hardware becomes extremely large in scale, thus resulting in a complicated system construction.

SUMMARY OF THE INVENTION

An object of the present invention is to provide a digital tone generating system, wherein the above described problems are eliminated.

Another object of the present invention is to provide a digital generating system, which is suitable for LSI use as the tone source circuit of an electronic musical instrument.

According to the present invention, an electronic musical instrument is provided so as to be equipped with wave generating means, wherein the wave generating means is composed of a wave memory and an address calculator for the wave memory, and a plurality of the wave data are provided in a time division multiplex form from said wave memory through the time division multiplex calculation by said address calculator for the wave memory.

Also, in the most preferable embodiment of the present invention, an electronic musical instrument is provided for causing tone signals by digital techniques, the instrument comprising a tone selecting means for selecting tone colors in accordance with a musical setting performed by a player, a keyboard means by which the player performs the melody or accompanies the musical setting, a processing means for inputting tone color data from said tone selecting means and key data from said keyboard means to thereby give given instructions to each means, a wave generating means for generating digital data in a time division multiplex form of a plurality of tone waves in accordance with the instructions from said processing means, an envelope generating means for generating digital data in a time division multiplex form of a plurality of envelopes in accordance with the instructions from said processing means, a multiplier means for multiplying, with time division multiplexing, the digital data of a plurality of tone waves from said wave generating means by the digital data of a plurality of envelopes from said envelope generating means thereby to provide digital data in a time division multiplex form of a plurality of tone signals with envelopes attached thereto, a digital-to-analog converter for converting the digital data of the tone signals from said multiplier means into analog signals, a clock rejection filter for rejecting the clock component contained in the analog signal from said digital-to-analog converter, and an electro-acoustical converting means for converting the tone signals from said clock rejection filter into acoustic signals.

BRIEF DESCRIPTION OF THE DRAWINGS

These objects and other objects, features, aspects and advantages of the present invention will become more apparent from the following detailed description of the present invention when taken in conjunction with the accompanying drawings in which:

FIG. 8 is a graph showing sine wave curves of 3 phase clocks outputted from the wave ROM6 of FIG. 1;

FIG. 9 is an explanatory diagram showing the construction of the envelope ROM7 of FIG. 1;

FIG. 10 is an explanatory diagram showing a set of addresses outputted from the envelope ROM7 of FIG. 1;

Referring to FIG. 1, a tone selecting means 1 indicates a draw-bar, tone tablet switches, etc,. and a player can operate the draw-bars, tone tablet switches, etc. to select the tones. Keyboards 2 indicate a solo keyboard, an upper keyboard, a lower keyboard, a pedal keyboard, etc., and the player performs a tune on these keyboards. A microcomputer 3 inputs the tone color data and key data from the tone selecting means and the keyboards 2 and provides necessary instructions to an address calculator 4 for wave ROM6 and an address calculator 5 for envelope ROM7 in accordance with the tone color data and key data. The address calculator 4 for wave ROM6 and the address calculator 5 for envelope ROM7 accesses the wave ROM6 and the envelope ROM7, respectively. The digital wave data and the digital envelope data obtained through the accessing operation of the wave ROM6 and the envelope ROM7 are digitally multiplied by a multiplier 8 to provide an envelope-added tone signal data. The tone signal data is converted into analog values from the digital values by a digital-to-analog converter 9 and pass through a clock rejection filter 10 and a power amplifier 11 to be output from a loud speaker 12.

The wave ROM6 will be described hereinafter. Referring to FIG. 2, if a period ($x=0$ through $2\pi$ radian) of the x axis of sinusoidal wave represented by the following equation.

$$f(x) = A \sin x \tag{1}$$

is equally divided by n and $x_0, x_1, x_2, \ldots x_i \ldots x_{n-1}$ ($x_n = n_0$) are provided, $$x_i = \frac{2\pi i}{n} \quad (i = 0, 1, 2, \ldots, n-1) \tag{2}$$

is established. The sampled value $f(x_i)$ of sinusoidal wave with respect to the $x_i$ is as follows from the equation (1), $$f(x_i) = A \sin x_i = A \sin \frac{2\pi i}{n} \tag{3}$$

The $f(x_i)$ is quantized, and is written, as a digital value, in the wave ROM6 and is read to sequentially read the clock $f_{CK}$[Hz]. It is noted that i increases by one for each $1/f_{CK}$[sec] (assume that $x_n = x_0$ is read after the $x_{n-1}$ and $x_1, x_2, x_3 \ldots$ are repeated in sequence) to establish the equation $$i = \frac{t}{1/f_{CK}} = f_{CK} \cdot t \tag{4}$$

Similarly, when the jumping read is performed m by m, i increases m by m for each $1/f_{CK}$[sec] to establish the following equation.

$$i = \frac{t}{1/f_{CK}} \cdot m = m \cdot f_{CK} \cdot t \tag{5}$$

When the equation (5) is substituted into the equation (3), $$f(x_i) = A \sin 2\pi \cdot \frac{m f_{CK}}{n} \cdot t = A \sin 2\pi f t \tag{6}$$

is established. Namely, the frequency f of the sinusoidal wave to be read from the wave ROM6 is as follows.

$$f = \frac{m}{n} f_{CK} \tag{7}$$

Figure 1:
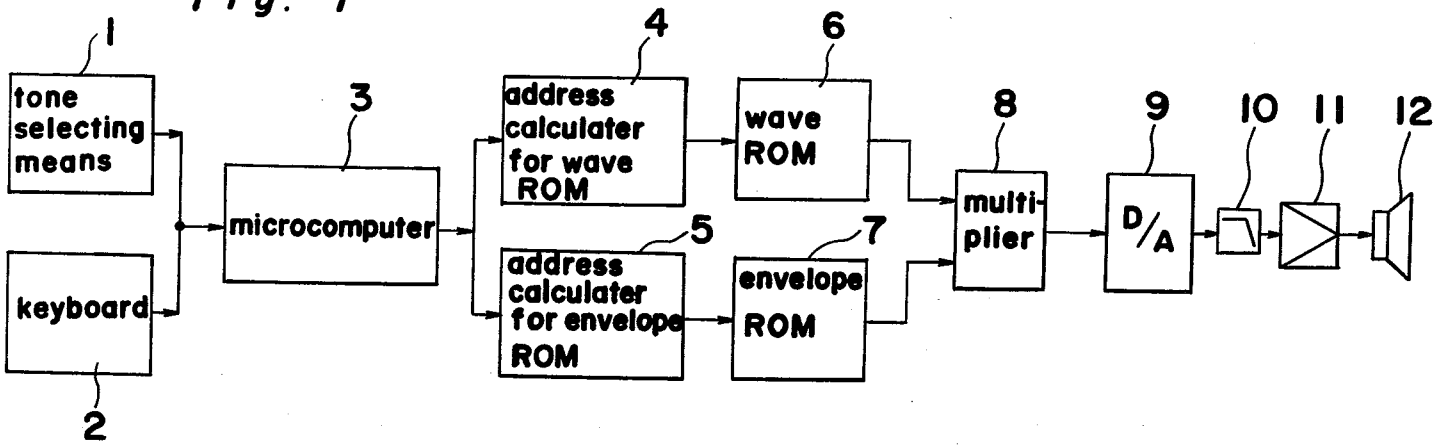
FIG. 1 is a block diagram showing all components of an electronic musical instrument in accordance with the first embodiment of the present invention.
Figure 2:
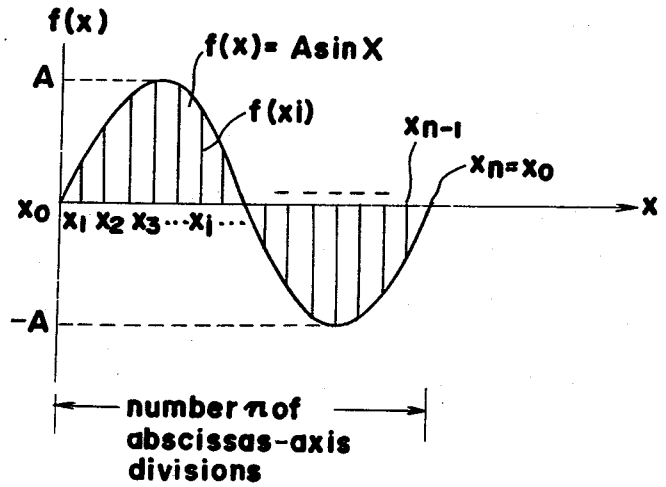
FIG. 2 is a graph showing a single sine wave curve of a wave ROM6 accessed by the address calculator of FIG. 1.

Assume that the wave form ROM having such a value as shown in FIG. 1 is provided for each of the notes, and the reading operation is performed at a constant $f_{CK}$ so that the tone signal (sinusoidal wave) of each note of the notes C, C#, D, . . . B has an error of ±1.19 cents or less in practical use.

TABLE 1

| Note | Divisor n of Each Note: Divisor n | Cent Error |
|---|---|---|
| C | 451 | +0.078 |
| C# | 426 | −1.193 |
| D | 402 | −0.804 |
| D# | 379 | +1.193 |
| E | 358 | −0.121 |
| F | 338 | −0.597 |
| F# | 319 | −0.437 |
| G | 301 | +0.114 |
| G# | 284 | +0.762 |
| A | 268 | +1.151 |
| A# | 253 | +0.866 |
| B | 239 | −0.582 |

When the $f_{CK}$ is rendered constant like $f_{CK}=14749.802$ [Hz], the sinusoidal wave of approximately 65.4 Hz (8 feet of $C_1$) is provided as is apparent from the equation (7) wherein n=451, m=2, and the sinusoidal wave of approximately 69.3 Hz (8 feet of $C^{\#}_1$) is provided as is apparent from the equation (7) wherein n=426, m=2. Similarly, the wave ROM6 which is different in n is read with a constant $f_{CK}$ to provide the tone signals of all the notes.

Also, since 8 feet (about 65.4 Hz) of $C_1$ is provided during n=451 and m=2, 8 feet (about 130.8 Hz) of $C_2$ is provided during n=451 and m=4, and 8 feet (about 261.6 Hz) of $C_3$ is provided during N=451 and m=8. It has been found that the octave treatment of the same note can be performed by the proper change of the value m.

Since the 8 feet (about 65.4 Hz) of the $C_1$ is provided during n=451 and m=2, the 4 feet of the $C_1$, i.e., second harmonics (about 130.8 Hz) is provided during n=451 and M=4, the $2\frac{2}{3}$ feet of the $C_1$, i.e., third harmonics (about 196.2 Hz) is provided during n=451 and m=6, and the 2 feet of the $C_1$, i.e., fourth harmonics (about 261.6 Hz) is provided during n=451 and m=8. Accordingly, it has been found that the tone signals of the generating harmonics can be controlled through the selection of the value of m. One example of the values of the m will be described in Table 2.

TABLE 2

| frequency | One Example of Values of m: Note $C_1 \sim B_1$ | $C_2 \sim B_2$ | $C_3 \sim B_3$ | $C_4 \sim B_4$ | $C_5 \sim B_5$ | $C_6$ |
|---|---|---|---|---|---|---|
| 16′ | 1 | 2 | 4 | 8 | 16 | 32 |
| 8′ | 2 | 4 | 8 | 16 | 32 | 64 |
| $5\frac{1}{3}$′ | 3 | 6 | 12 | 24 | 48 | 96 |
| 4′ | 4 | 8 | 16 | 32 | 64 | 128 |
| $2\frac{2}{3}$′ | 6 | 12 | 24 | 48 | 96 | 192 |
| 2′ | 8 | 16 | 32 | 64 | 128 | 256 |
| 1 3/5′ | 10 | 20 | 40 | 80 | 160 | 320 |
| $1\frac{1}{3}$′ | 12 | 24 | 48 | 96 | 192 | 384 |
| 1′ | 16 | 32 | 64 | 128 | 256 | 512 |

As apparent from the equation (7), the value of n or m is changed, if $f_{CK}$ is constant, to allow the tone frequency to be controlled with a considerable degree of freedom.

If about 65.4 Hz (sound of $C_1$), which is obtained during n=451 (wave ROM of C) and m=2, is rendered fundamental in wave, harmonics (about 686.7 Hz), i.e., non-integer harmonics of 10.5 times as high during m=21, are obtained. Also, during n=301 (wave ROM of G) and m=4, about 196.0 Hz, i.e., slightly lower third harmonics are generated, i.e. $2\frac{2}{3}$ feet, which is lower by about two cents.

Figure 3:
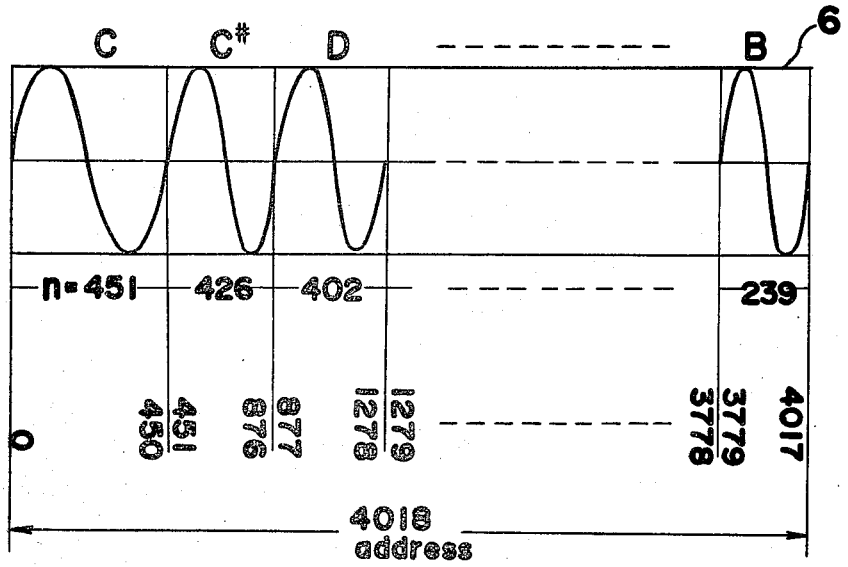
FIG. 3 is a graph showing a set of sine wave curves outputted from the ROM6 of FIG. 1.

As shown in FIG. 3, the wave ROM of each tone of C, C#, D, . . . B is constructed. Assume that the value of n is as shown in FIG. 1, and the address of the wave ROM6 of the C note is 0 through 450, C# note is 451 through 876, D note is 877 through 1278, . . . B note is 3779 through 4017. The entire address is 4018, which is the total of 0 through 4017. The wave data of the sinusoidal wave is written, in the form of a digital value, in the wave ROM. When the optional address value up to 4017 from 0 is given to the wave ROM, the wave data of the sinusoidal wave stored in the wave ROM is read as a digital value.

Figure 4:
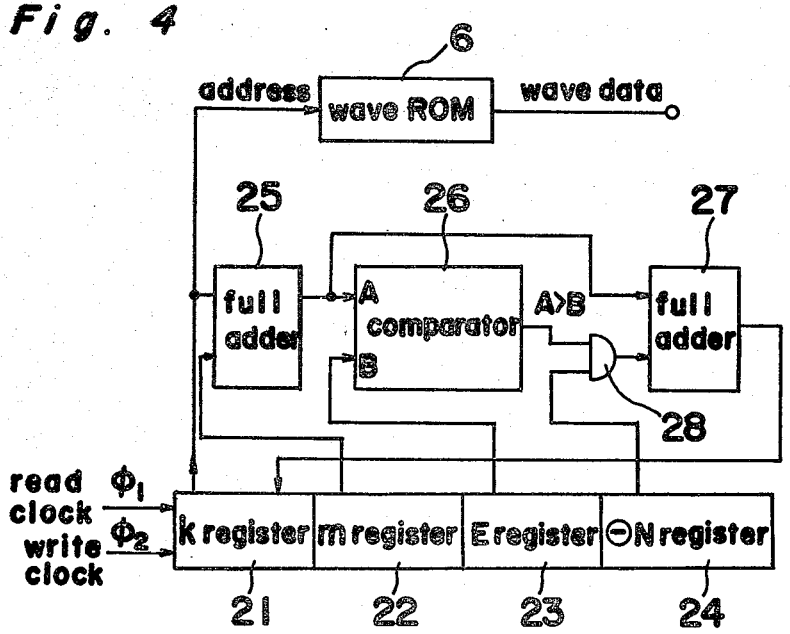
FIG. 4 is a block diagram showing parts of the ROM address calculator of FIG. 1.

A method of reading the wave data from the wave ROM6 will be concretely described hereinafter in conjunction with FIG. 4 showing a circuit construction for describing the operation of the wave ROM address calculator 4.

As shown in FIG. 4, there are disposed a k register 21 for storing the address value of the wave ROM6, an m register 22 for storing the number of jumps m, an E register 23 for storing the end address value, a ⊖N register for storing the negative value of the divisor n, an adder 25, a comparator 26, an adder 27 and an AND gate 28.

Figure 5:
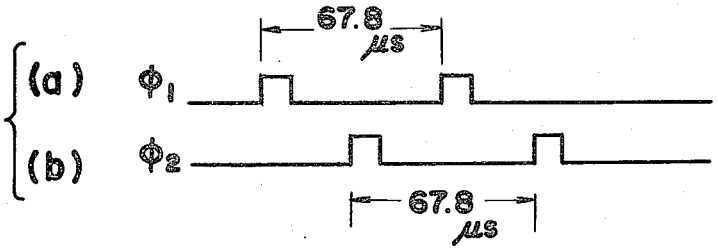
FIG. 5 is a graph showing a set of waves outputted from the registers of FIG. 4.

For example, described below is a case where the form of 8 feet (about 69.2 Hz) of $C^{\#}_2$ will be read. As in the previous case, assume that $f_{CK}=14749.802$ Hz. At this time, the wave ROM (n=426) of C# is required to be read with two jumps (m=2). Since the wave data is from the address 451 to 876 as shown in FIG. 3, 451 as the start address is stored in the k register 21, and 876 as the end address is stored in the E register 23. Since the divisor n=426 and jump m=2, ⊖426 as a negative value of the divisor is stored in the ⊖N register 24 and 2 as the jump is stored in the m register 22. Since $f_{CK}=14749.802$ Hz, $1/f_{CK}=67.8$ μs is established. As shown in FIG. 5, a read clock $\phi_1$ and a write clock $\phi_2$ for four registers 21 through 24 are both assumed to have 67.8 μs periods and two phases. Upon application of the read clock $\phi_1$, a value of 451 is obtained from the output terminal of the k register 21 and is supplied to the address terminal of the wave ROM6 to provide the wave data of C#. The 451 from the output terminal of the k register 21 and the 2 from the m register 22 are added by the full adder 25, and the value of 453 is given to the A terminal of the comparator 26 and to the full adder 27. The end address 876 from the E register 23 is added to the B terminal of the comparator 26 to compare the value of the A terminal with the value of the B terminal. However, in this case, no output is provided at the A>B terminal and the value is 0, since 876 is larger than 453. As a result, the output of the AND gate 28 becomes 0 independently of the value ⊖426 of the ⊖N register 24. The full adder 27 adds a value 453 coming from the full adder 25 and 0 coming from the AND gate 28 (thus resulting in no addition) to give a value of 453 to the input terminal of the k register 21. When the write clock $\phi_2$ has come, the value of 453 from the full adder 27 is written in the k register. As a result, the value of the k register is rewritten to 453 from 451 and the value of the m register is rewritten from 451 to 453, which is obtained through addition of the value 2 of the m register 22.

Upon addition of the read clock $\phi_1$ to four registers 21, 22, 23, 24 again, the value of 453 is obtained from the output terminal of the k register 21 and is added to the address terminal of the wave ROM6 to provide the wave data to the C#. Simultaneously, through the full adder 25, the comparator 26, the AND gate 28 and the full adder 27, 455, which is provided through addition of 453 coming from the output terminal of the k register 21 to 2 coming from the m register 22, is added to the input terminal of the k register 21 and is written when the write clock $\phi_2$ has come.

In this manner, the value of the k register 21 sequentially increases by two jumps in the order of 451, 453, 455, 457, 459 . . . In keeping with the sequential increase, the wave data of two address jumps is sequentially obtained from the wave ROM6. However, the address of the wave ROM6 ranges from 451 to 876. Beyond the range, the wave data of the C# results in that of its adjacent D note. To prevent it, the comparator 26 compares the value from the full adder 25 with the end address 876 from the E register 23. If the value from the full adder 25 is 876 or more, the output terminal A>B of the comparator 26 becomes 1 to provide the output of the AND gate 28 with the value ⊖426 from the ⊖N register. The full adder 27 adds the value of the full adder 25 to the value of ⊖426 from the AND gate 28, i.e., subtracts 426 so that the end address 876 may not be exceeded by any means. The value of the k register 21 increases from 451 in the order of 453, 455, 457, 459, . . . When 875 has been reached, the output of the full adder 25 becomes 877. Through comparison thereof with 876 by the comparator 26, the full adder 27 performs the operation of 877-426 to write 451 in the k register 21. Accordingly, since the value of the k register 21 is normally repeated in the order of 451, 453, 455, 457, . . . 875, 451, 453, . . . , only the values from 451 to 876 are available. The wave data of only the C# note of the wave ROM6 is repeatedly read. If m=4, the order of 451, 455, 459, 463, 467, . . . 875, 453, 457, 461 . . . is repeated.

Figure 6:
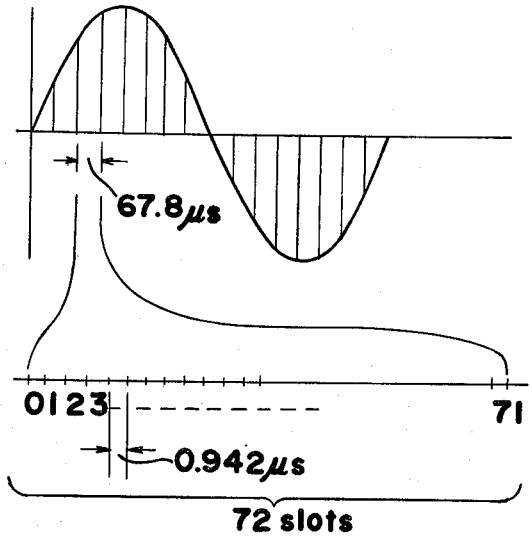
FIG. 6 is a graph showing a sine wave curve outputted from the wave ROM6 of FIG. 1.

Since the value of the k register 21 is updated for each 67.8 μs period of the two phase clocks $\phi_1$, $\phi_2$, the wave data obtained from the wave ROM6 is obtained for each 67.8 μs as shown in FIG. 6 so that the sampled sinusoidal wave is obtained by the clock of $f_{CK}$=14749.802 Hz.

When 8 feet of the other note such as $D_2$ note is read, n=402 and m=4 are established. Since the wave data of the D note ranges from the address 877 of the wave ROM6 to 1278 as shown in FIG. 3, 877 is written in the k register 21 and 1278 is written in the E register 23. Write ⊖402 in the ⊖N register 24 and 4 in the m register 22, and the waveform data is automatically read, through the similar operation, from the wave ROM6 for each 67.8 μs.

In the above-described manner, the wave data can be read from the wave ROM6 by such a wave ROM address calculator as described in FIG. 4. Only one wave can be read at a time. In the case of such as draw-bar tone source, assume that the number of the pitches of the drawbars is equal to 9, i.e., 16 feet, 8 feet, 5⅓ feet, 1 3/5 feet, 1⅓ feet and 1 feet, and the number of the channels for maximum, simultaneous pronunciation is equal to 8, then seventy two (nine pitches×8 channels) wave ROM address calculators are required.

Figure 7:
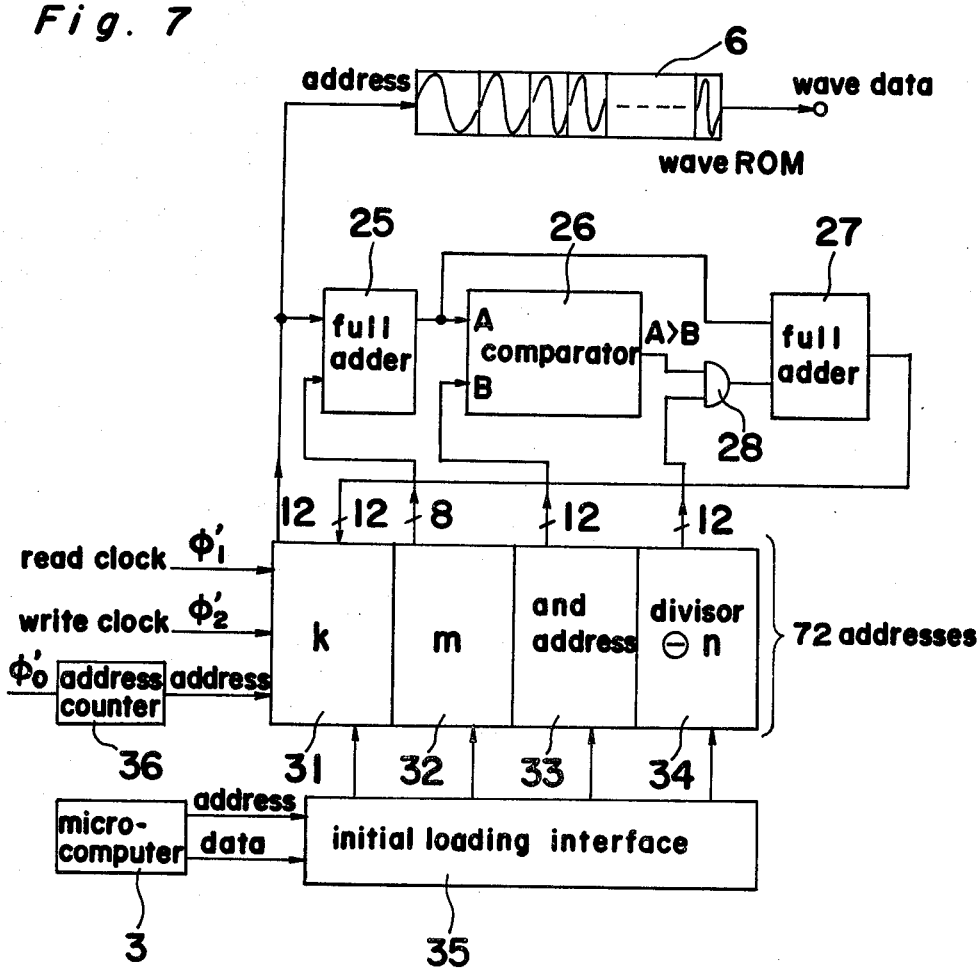
FIG. 7 is a graph for illustrating the wave reading operation of the wave ROM address calculator of FIG. 1.

However, since the clock frequency is normally fixed in accordance with the method of the present invention, the circuit can be put for common use if the timing of the hardware is rendered definite. Namely, a time division multiplexing operation can be effected. FIG. 7 shows a wave ROM address calculator 4, which can read seventy-two (as a maximum) independent waveforms by the time division multiplexing operation. The timing for reading one wave is performed for each 67.8 μs as shown in FIG. 6, and the 67.8 μs is divided by time into 72 slots. Namely, one slot is approximately 0.942 μs. The completely independent waveform reading operation is performed for each of the slots. The minimum data necessary for reading one wave requires the address value k for accessing the wave ROM6, the number of jump m, the end address E and the negative figure ⊖n of the divisor n. In FIG. 7, four random access read/write memories (hereinafter referred to as RAMs) 31, 32, 33 and 34, having 72 addresses, are provided, to independently store the k, m, E and ⊖n values for 72 slots. Since the RAM is higher in accumulation degree and superior in productivity, the load does not become as large as the hardware. The initial value to these RAMs is written through an initial loading interface 35 from the microcomputer 3. A full adder 25, a comparator 26, a full adder 27, an AND gate 28 and a wave ROM6 may be the same as those of FIG. 4. These circuits may be common in 72 slots to perform the time division multiplexing calculation, which helps to simplify the hardware. Four RAMs are accessed in common by a slot address counter 36 which counts a clock $\phi'_0$. Also, the clocks $\phi'_1$ and $\phi'_2$ for reading to and storing in these RAMs commonly works for four RAMs. The timing of three clocks of these $\phi'_0$, $\phi'_1$ and $\phi'_2$ is, respectively, 0.942 μs as shown in FIG. 8 and is a 3-phase clock which is different in phase.

How to assign the seventy-two addresses of RAMs 31, 32, 33, 34 is completely arbitrary. For example, the assignment can be performed as in Table 3. These address values conform to the slot values of the time division multiplexing.

TABLE 3

| | RAM Assignment | | | |
|---|---|---|---|---|
| | Address Values | | | |
| RAM Address | k | m | E | ⊖n |
| 0 | k value of 16′ of CH1 | m value of 16′ of CH1 | E value of 16′ of CH1 | ⊖n value of 16′ CH1 |
| 1 | k value of 8′ of CH1 | m value of 8′ of CH1 | E value of 8′ of CH1 | ⊖n value of 8′ CH1 |
| 2 | k value of 5⅓′ of CH1 | m value of 5⅓′ of CH1 | E value of 5⅓′ of CH1 | ⊖n value of 5⅓′ of CH1 |
| 3 | k value of 4′ of CH1 | m value of 4′ of CH1 | E value of 4′ of CH1 | ⊖n value of 4′ of CH1 |
| . | . | . | . | . |
| . | . | . | . | . |
| . | . | . | . | . |
| 9 | k value of 16′ of CH2 | m value of 16′ of CH2 | E value of 16′ of CH2 | ⊖n value of 16′ of CH2 |
| 10 | k value of 8′ of CH2 | m value of 8′ of CH2 | E value of 8′ of CH2 | ⊖n value of 8′ of CH2 |
| 11 | k value of 5⅓′ of CH2 | m value of 5⅓′ of CH2 | E value of 5⅓′ of CH2 | ⊖n value of 5⅓′ of CH2 |
| 12 | k value of 4′ of CH2 | m value of 4′ of CH2 | E value of 4′ of CH2 | ⊖n value of 4′ of CH2 |
| . | . | . | . | . |

TABLE 3-continued

| RAM Address | RAM Assignment Address Values k | m | E | ⊖n |
|---|---|---|---|---|
| . | . | . | . | . |
| . | . | . | . | . |
| 18 | k value of 16′ of CH3 | m value of 16′ of CH3 | E value of 16′ of CH3 | ⊖n value of 16′ of CH3 |
| 19 | k value of 8′ of CH3 | m value of 8′ of CH3 | E value of 8′ of CH3 | ⊖n value of 8′ of CH3 |
| 20 | k value of 5⅓′ of CH3 | m value of 5⅓′ of CH3 | E value of 5⅓′ of CH3 | ⊖n value of 5⅓′ of CH3 |
| 21 | k value of 4′ of CH3 | m value of 4′ of CH3 | E value of 4′ of CH3 | ⊖n value of 4′ of CH3 |
| . | . | . | . | . |
| . | . | . | . | . |
| . | . | . | . | . |
| 71 | k value of 1′ of CH8 | m value of 1′ of CH8 | E value of 1′ of CH8 | ⊖n value of 1′ of CH8 |

Assume that the draw-bars of 8 feet and 4 feet are in their pulled positions and three keys of $C_3$, $E_3$ and $G_3$ are in their depressed positions. Assume that the microcomputer 3 inputs this data, assigns $C_3$ to CH1, $E_3$ to $CH_2$ and $G_3$ to CH3. The writing operation is effected, through an initializing interface 35, with respect the four RAMs 31, 32, 33 and 34. As is apparent from Table 3, the 8 feet of the $C_3$ becomes a RAM address 1, the 4 feet of the $C_3$ becomes a RAM address 3, the 8 feet of the $E_3$ becomes a RAM address 10, the 4 feet of the $E_3$ becomes a RAM address 12, the 8 feet of the $G_3$ becomes a RAM address 19 and the 4 feet of the $G_3$ becomes a RAM address 21. Thus, as is apparent from Table 2 and FIG. 3, 0 is written in the kRAM of the RAM address 1, 8 is written in the mRAM, 450 is written in the ERAM, ⊖451 is written in the ⊖NRAM, 0 is written in the kRAM of the RAM address 3, 16 is written in the mRAM, 450 is written in the ERAM, and ⊖451 is written in the ⊖NRAM. The initial values from Table 2 and FIG. 3 are written even in the kRAM, mRAM, ERAM and ⊖NRAM of the RAM addresses 10, 12, 19 and 21.

When a clock enters the $\phi'_0$ of FIG. 7, the address counter 36 is renewed to simultaneously update the addresses of the four RAMs 31, 32, 33 and 34. Assume that the RAM address has changed from 0 to 1, and the k, m, E, ⊖n of the RAM address 1 are read from the respective RAMs when the read clock $\phi'_1$ has been provided. The value 0 of the kRAM is fed into the wave ROM6 to provide the wave data of 8 feet of the $C_3$. The value 8 is written into the kRAM when the write clock $\phi'_2$ has been provided by the same operation as the operation already described in FIG. 4. When the clock of the $\phi'_0$ has been provided, the address counter 36 counts up to change the RAM address from 1 to 2. The similar operation is effected even in the RAM address 2. The RAM address is adapted to cycle again to return to its original value upon application of 72 clocks to the $\phi_0$, and the address becomes the address 1 again. The value of 8 is applied upon the ROM address from the kRAM when the $\phi'_1$ clock has been provided and the value of 16 is simultaneously written in the kRAM at the $\phi'_2$ clock. Namely, as is apparent from the RAM address 1 only, the $\phi_0$ repeats the same operation as that of FIG. 4 everytime 72 clocks enter. Even in the other RAM address such as RAM address 10 to which the 8 feet of $E_3$ is assigned, the $\phi_2$ performs the same operation as that of FIG. 4 everytime 72 clocks enter. Since the clock of the $\phi_0$ is 0.942 μs, the 72 clocks is 67.8 μs and remains the same as in FIG. 4.

Namely, the use is performed under the time division multiplexing operation, with the adder 25, the comparator 26, the full adder 27, the AND gate 28 and the wave ROM6 remaining unchanged, through the replacement of the RAM having 72 addresses therein instead of the four registers 21, 22, 23 and 24 in FIG. 4. For the time division multiplexing operation of 72 data batches, a multiplexer (multiplex selection means) for switching the seventy-two signals is normally required to be provided, but in FIG. 7, the multiplexer is not required to be provided. The time division multiplexing operation is automatically performed. An arithmetic logic circuit of the adder 25, the comparator 26, the full adder 27 and the AND gate 28 performs the time division multiplexing operation for each 0.942 μs time period in accordance with the order of the RAM addresses. In terms of a specific RAM address, it follows that one operation is performed for each 67.8 μs. Even in the reading of the wave data from the ROM6, the time division multiplexing reading for each 0.942 μs is performed in accordance with the order of the RAM address. In terms of a specific RAM address, it follows that a given wave data is sequentially read for each 67.8 μs. Time division multiplexing operation of the 72 slots is performed during 67.8 μs and the 72 sinusoidal waves are read at maximum. One tone wave is read with one slot. In addition, the reading of each slot is completely independent. Namely, it is considered that the system construction of FIG. 7 is equivalent to seventy-two independent sinusoidal wave oscillators.

The envelope generation will be described hereinafter. The envelope is generated in synchronous relationship with the wave generation. The seventy-two (at maximum) envelope signals are provided in the form of a time division multiplexing operation. There are some generating methods for envelope signals, and one of them will be described hereinafter although the generating method is not specified.

First, the envelope ROM7 will be described hereinafter.

FIG. 9 is one example, wherein the envelope ROM7 is composed of a 256 address ROM from 00000000(2) to 11111111(2). The whole portion is equally divided into eight pieces. The quantized rise-up and fall-down exponential envelopes which are different in amplitude are sequentially written digitally into each of eight divisions. The condition of the respective rise-up envelope and fall-down envelope is apparent in the address of the ROM seen from a binary viewpoint. Namely, as shown in FIG. 10, 3 bits from the most significant bit, i.e., $D_7$ through $D_5$ can have eight values from 000 to 111. The value 000 is smallest in amplitude and the value 111 is largest in amplitude. When the bit $D_4$ is 0, the rise-up envelope is indicated. When the bit $D_4$ is 1, the fall-down envelope is indicated. When the $D_3$ through $D_0$ shows 0000, it means the beginning of the rise-up envelope or the fall-down envelope. When the $D_3$ through $D_0$ shows 1111, it means the end of the rise-up envelope or the fall-down envelope.

Figure 11:
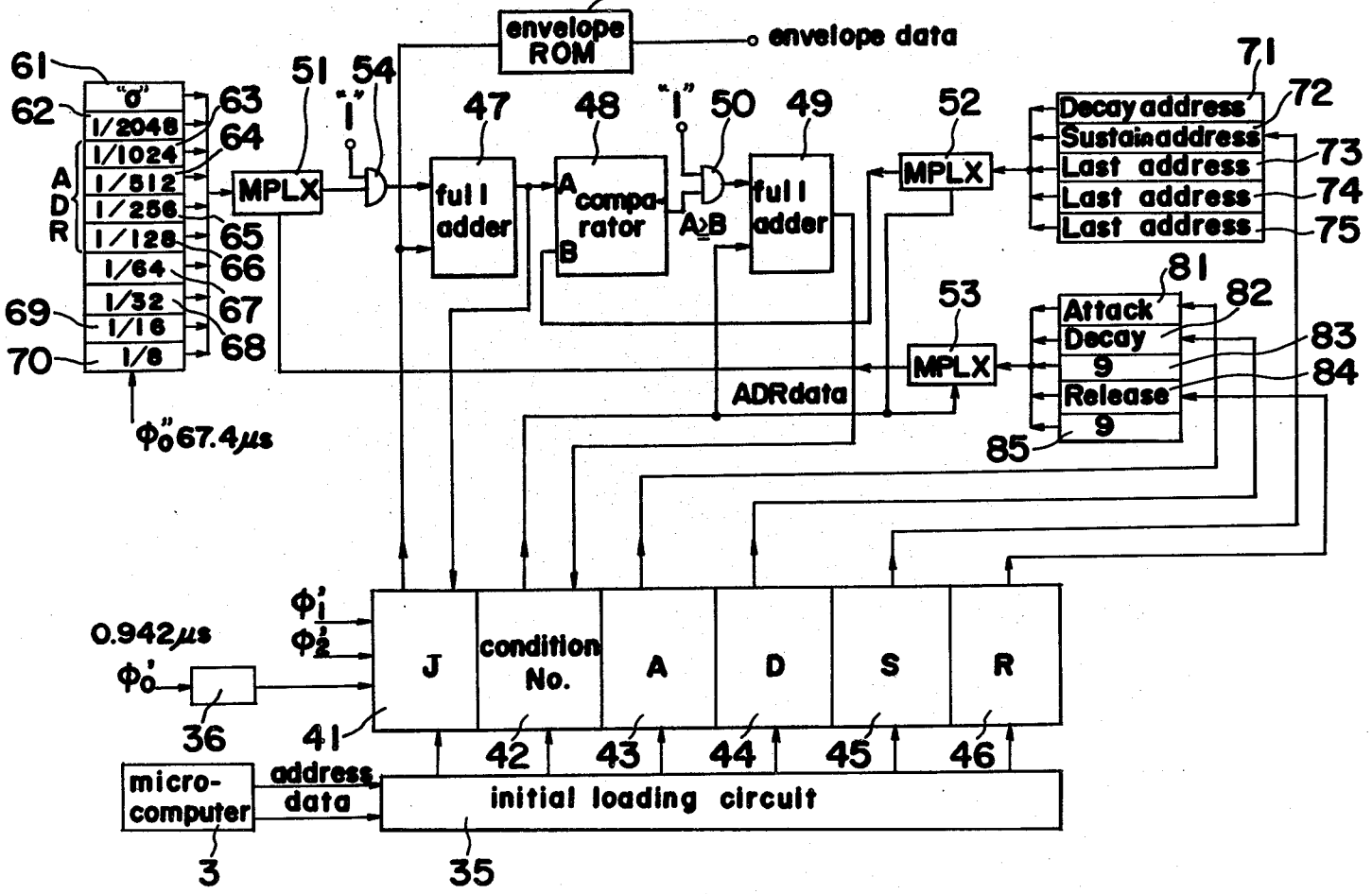
FIG. 11 is a block diagram showing parts of the envelope ROM address calculator of FIG. 1.

The concrete construction of the envelope ROM address calculator 5 is shown in FIG. 11. The calculator 5 generates seventy-two (at maximum) independent envelope data batches through the time division multiplexing operation. The calculator is adapted to operate in a synchronous relationship with the wave ROM address calculator 4. The minimum data necessary for reading one envelope requires an address value J for accessing the envelope ROM, an attack speed value A for determining the attack speed of the envelope, a decay speed value D for determining the decay speed, a sustain address value S for determining the sustain level, a release speed value R for determining the release speed, and a state code showing which of the attack, decay, sustain, release and completion the envelope is located in. They are independentaly stored for the 72 slots with respect to six RAMs 41, 42, 43, 44 45 and 46 having one address. The writing of these initial values to the RAM is performed through the initial loading interface 35 (which is the same as that of FIG. 7) from the microcomputer 3. The address counter 36 is used in common with that of FIG. 7. The four RAMs 21, 22, 23 and 24 of FIG. 7 becomes completely the same in address as the six RAMs 41, 42, 43, 44, 45 and 46 of FIG. 11, so that the wave ROM address calculator 4 and the envelope ROM address calculator 5 will operate, retaining the synchronous relationship at the same timing. In FIG. 11, full adders are generally designated at 47 and 49, respectively, a comparator is generally designated at 48, and an AND gate is generally designated at 50.

Dividers 62, 63, 64, 65, 66, 67, 68 and 69, respectively, divide the pulse of 67.4 μs from $\frac{1}{8}$ to 1/2048 to generate a pulse of from 539.2 μs to 138.04 ms. One of the dividing pulses from these dividers is selectively switched by a multiplexer 51. Registers 71, 72, 73, 74 and 75 store comparative data to selectively switch the data by a multiplexer 52. Registers 81, 82, 83, 84 and 85 are adapted to temporarily retain the data to selectively switch by a multiplexer 53. The full adders 47, 49, the comparator 48, the AND gate 50, the multiplexers 51, 52, 53 may be common in 72 slots and use the time division multiplexing. The read clock $\phi'_1$ and the write clock $\phi'_2$ are the same as those of FIG. 7. The timing thereof is shown in FIG. 8.

The assignment of each slot of the six RAMs 42 through 46 is required to be the same as that of the wave ROM address calculator of FIG. 7. Namely, the RAM address 0 is required to become the 16′ of the CH1, the RAM address 1 is required to become the 8′ of the CH1, . . . The RAM address 72 is required to become 1′ of the CH8.

Assume that the keys of $C_3$, $E_3$, $G_3$ are depressed as in the case described hereinabove, the draw-bar of the 8′ is in its fully pulled position and the draw-bar of the 4′ is in its slightly pulled position. As a result, assume that the microcomputer 3 assigns $C_3$ to the CH1, $E_3$ to the CH2, and $G_3$ to the CH3, and the microcomputer 3 writes the data necessary for six RAMs through the initial loading interface 35. The 8 feet envelope data for $C_3$ is written in the RAM address 1 and the 4 feet envelope data for $C_3$ is written in the RAM address 3. Similarly, the 8 feet envelope data for $E_3$ is written in the RAM address 10. The 4 feet envelope data for $E_3$ is written in the RAM address 12. The 8 feet envelope data for $G_3$ is written in the RAM address 19. The 4 feet envelope data for $G_3$ is written in the RAM address 21.

Since the 8 feet draw-bar is fully pulled, 11100000(2) (an envelope of maximum volume) is written in the J-RAMs of the RAM addresses 1, 10 and 19. Also, since the 4-feet draw-bar is slightly pulled, 00000000(2) (an envelope of minimum volume) is written in the J-RAMs of the RAM addresses 3, 12 and 21. Also, 000(2) is written, respectively, in all the state code RAMs of the RAM addresses 1, 3, 10, 12, 19 and 21. The state codes are shown as in Table 4. At the same time, the attack data, the decay data and the sustain data are written, respectively, in the A-RAM, D-RAM, S-RAM and R-RAM.

TABLE 4

| State Code | Condition |
|---|---|
| 0 | attack |
| 1 | decay |
| 2 | sustain |
| 3 | release |
| 4 | completion |

A method of generating the ADSR envelope will be described hereinafter. In the case of the RAM address 1, the attack condition exists, since the initial value 000 is written in the state code RAM. The multiplexer 53 selects the value of the A-RAM of the RAM address 1 through the attack register 81. If the value of 2 is written therein, it is given to the multiplexer 51 through the multiplexer 53. As apparent from FIG. 5, the pulse of 2.156 ms is supplied to the AND gate 54 from the 1/32 divider 68. Since the output of the AND gate 54 becomes 1 for each 2.156 ms and the output is 0 at all other times, the full adder 47 adds one to the value of the J-RAM of the RAM address 1 for each 2.156 ms to increase the value to 11100001(2), 11100010(2), 11100011(2) . . . , 11101111(2) from 11100000(2) to thereby access from the envelope ROM7 the rise-up portion of the envelope of the maximum amplitude of FIG. 9. In this case, since the number of the addresses of the rise-up portion is 16, the rise-up time comes to 2.156 ms×16=34.5 ms.

TABLE 5

| ARD Data | Frequency Division Ratio | Frequency Division Pulse |
|---|---|---|
| 0 | 1/8 | 0.539 ms |
| 1 | 1/16 | 1.078 ms |
| 2 | 1/32 | 2.156 ms |
| 3 | 1/64 | 4.313 ms |
| 4 | 1/128 | 8.627 ms |
| 5 | 1/256 | 17.25 ms |
| 6 | 1/512 | 34.5 ms |
| 7 | 1/1024 | 69.0 ms |
| 8 | 1/2048 | 138.0 ms |
| 9 | "0" | ∞ ms |

On the other hand, the value of 0 from the state code RAM is supplied even to the multiplexer 52 to select the register 71. The 5 bits from the least significant bit of the address of the envelope ROM7, i.e., the address date 01111(2) of the $D_4$ through $D_0$ as shown in FIG. 10 is retained in the register. As is apparent from FIG. 9, the value shows 5 bits, from the least significant bit, of the last address of the rise-up envelope. The value of of 01111(2) from the register 71 is provided to the B terminal of the comparator 48 through the multiplexer 52. The 5 bits from the least significant bit of the full adder 47 is supplied to the A terminal. The comparator 48 checks whether or not the rise-up envelope has been completed. When the values of the A terminal has exceeded the value of the B terminal, the comparator 48 output A>B becomes 1 so that the output of the AND gate 50 becomes 1. Thus, the full adder 49 adds 1 to the value of the state code RAM of the RAM address 1, and accordingly, the value changes from 0 to 1. As is apparent from Table 4, the 1 means the decay condition. The multiplexer 53 selects the value of the D-RAM of the RAM address 1 through the register 82. When the value is 5, the value of 5 is added to the multiplexer 51. As is apparent from Table 5, the multiplexer 51 selects the frequency divider 65 of 1/256 to give a pulse to the AND gate 54 for each 17.25 ms. Thus, the value of the J-RAM keeps increasing by one for each 17.25 ms and changes in the order from 11110000(2) to 11110001(2), 11110010(2), 11110011(2), . . . The fall-down envelope of the envelope RAM of FIG. 9 is accessed. On the other hand, the value of 1 from the state code RAM is supplied to the multiplexer 52 and the value of S-RAM of the RAM address 1 is supplied to the B terminal of the comparator 48 through the register 72. The value of the S-RAM can have the values from 10000(2) to 11111(2) at the 5 bits, from the least significant bit, of the ROM address of the envelope ROM7. As is apparent from FIG. 9, the value is the address value of the fall-down envelope. For example, if the value of the S-RAM is 10111(2), the value is added to the B terminal of the comparator 48. The value of 5 bits, from the least significant bit, from the full adder 47 is provided to the A terminal. The value of the data at the A terminal is compared with the value 10111(2) of the B terminal. When A exceeds B, 1 is output at the A>B terminal of comparator 48 and is supplied to the AND gate 50. The full adder 49 increases the value of the state code RAM by one, and accordingly, the value changes from 1 to 2. As is apparent from Table 4, it means that the condition has been switched from the decay to the sustain. Under the decay condition, the value of the J-RAM has 8 addresses from 11110000(2) to 11110111(2) and thus, the time becomes equal to 17.25 ms×8=138 ms.

Under the sustain condition, the value of 2 from the condition RAM gives to the multiplexer 51 a value of 9, which is retained in the register 83 by the multiplexer 53. As is apparent from Table 5, the frequency divider 61 is selected with a value of 9. However, no pulses are ever provided from the frequency divider 61, and thus the value is normally 0. Accordingly, the output of the AND gate 54 is permanently 0 and the value of the J-RAM remains 11110111(2). Since the ROM address 11110111(2) of the envelope ROM7 remains permanently accessed, the envelope retains a constant level, which does not change with time, so as to realize a so-called sustain condition. Under this sustain condition, the multiplexer 52 selects the register 73 with a value of 2 from the condition RAM42. But value the 11111(2) which is a value of 5 bits from the least significant bit of the envelope ROM7 is retained in the register. As is apparent from FIG. 9, the value shows the last address of the fall-down envelope. Although the value is added to the B terminal of the comparator 48, the value of the J-RAM41 remains 11110111(2) and does not increase. A 1 does not appear at the A>B terminal of the comparator 48. The output of the AND gate 50 remains 0. As a result, the value of the state code RAM42 does not increase and retains a value of 2.

Since the RAM address 1 has the 8 feet of the $C_3$ assigned thereto, the sustain condition permanently remains so long as the key of the $C_3$ is in its depressed condition.

When the key of the $C_3$ is released, the microcomputer 3 inputs the keyboard data to enter the value of 3 to the state code RAM42 of the RAM address 1 and the RAM address 3 (since the 4 feet of $C_3$ is assigned even to the RAM address 3) through the initial loading interface 35. As is apparent from Table 4, this means release. The value of the 3 is added to the multiplexer 53. The multiplexer 53 selects the value of the R-RAM46 through the register 84 to supply it to the multiplexer 51. If the value of 8 is written in the R-RAM46, the 1/2048 frequency divider 63 is selected as is apparent from Table 5 and a pulse is fed to the AND gate 54 every 138.0 ms. Accordingly, the value of the J-RAM41 starts to increase again for each 138.0 ms by the full adder 47 and changes from 11110111(2) to 11111000(2), 11111001(2), 11111010(2), . . . to sequentially access the fall-down envelope of the envelope ROM7. On the other hand, the value of 3 from the state code RAM42 is provided even to the multiplexer 52 to select the register 74. The 11111(2) of the 5 bits of the least significant bit of the ROM address of the envelope ROM7 is stored in the register. This is the last address of the fall-down envelope. This value is supplied to the B terminal of the comparator 48 through the multiplexer 52 and is always compared with the value of the data at the A terminal from the full adder 47. If the value of A exceeds the value of B, and the value of J-RAM41 becomes 1111111(2) and comes to the fall-down last address of the envelope ROM7, the A>B terminal of the comparator 48 becomes 1. The full adder 49 adds 1 to the value of the state code RAM42, and accordingly, the value changes from 3 to 4. As is apparent from Table 4, the value of 4 means that the envelope has been completed. Since the value of the J-RAM41 has 8 addresses from 11110111(2) to 11111111(2) in the release period, a time of 138.0 ms×8=1.104 seconds is established.

The value of 4 from the state code RAM42 is added to the multiplexer 53 and the value of 9 is selected from the register 85. Thus, the value is supplied to the multiplexer 51 tnrough the multiplexer 53 to select the frequency divider 61 as is apparent from Table 5. As described hereinabove, since no pulses are supplied and a 0 normally remains, only the 0 is normally supplied through the multiplexer 51 to the AND gate 54. As a result, the value of the J-RAM41 remains 11111111(2). On the other hand, the value of 4 from the state code RAM42 is fed to the multiplexer 52. As a result, the value 1111(2) of the 5 bits from the least significant bit of the envelope ROM7 is provided to the B terminal of the comparator 48 through the multiplexer 52 from the register 75. Since the value of the J-RAM41 remains unchanged at 11111111(2), the five bits value, from the least significant bit, from the full adder 47 becomes 11111(2) so that the value of the data at the A terminal of the comparator 49 does not exceed the value of the B terminal. Accordingly, since the A>B terminal of the comparator 49 permanently becomes 0 and the ouput of the AND gate 50 remains 0, the state code RAM42 remains 4. As a result, unless a new key is assigned, from the microcomputer 3, to the RAM ADDRESS 1, the value 11111111(2) is permanently retained in the J-RAM and 4 remains in the state code RAM42. The final envelope data of the fall-down envelope of the envelope ROM7, i.e., a condition where the envelope has been fallen down (condition of no sounds) remains.

Figure 12:
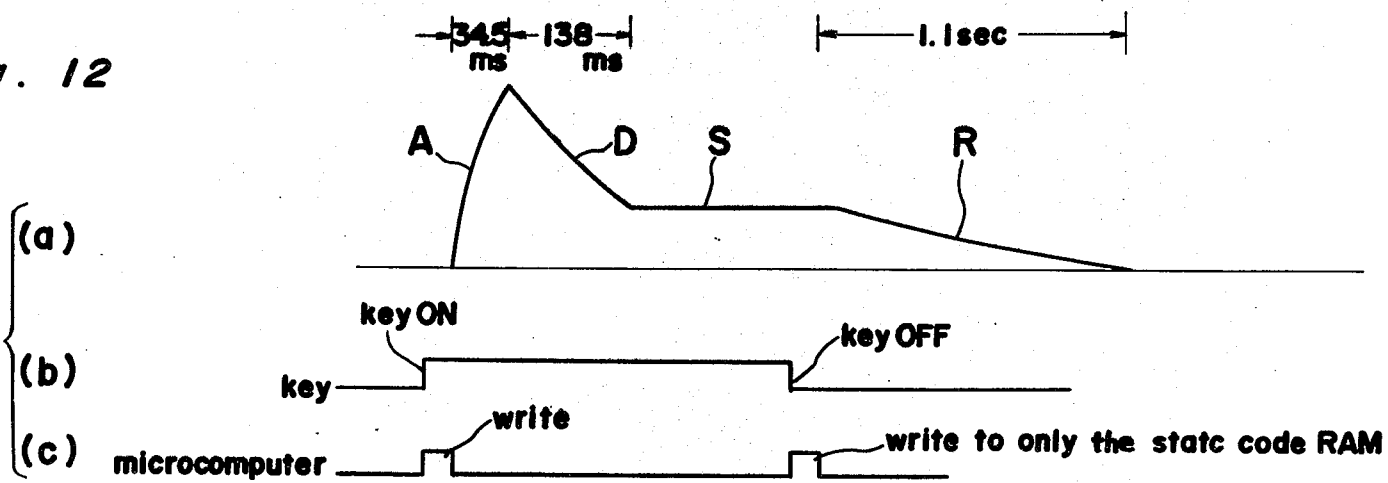
FIG. 12 is a graph showing waves outputted from the envelope ROM7 of FIG. 1.

The ADSR envelope obtained by the above description is shown in FIG. 12. It can be easily understood from the above description that the attack time, the decay time, the sustain level and the release time can be freely changed when the initial value to be written from the microcomputer 3 in each of the A-RAM43, D-RAM44, S-RAM45, R-RAM46 is changed. As is apparent from FIG. 5, the attack time, the decay time and the release time become shorter when the initial values, to be written in the A-RAM43, D-RAM44 and R-RAM46, are rendered smaller, and become longer when the initial values are rendered larger. Also, as is apparent from FIG. 9, when the initial value to be written in the S-RAM becomes closer to 10000(2), the sustain level becomes larger. When it becomes closer to 11111(2), the sustain level becomes smaller. Since the ADSR envelope can be freely set as described hereinabove, most of the simulations for existing musical instruments can be realized.

Although the case of only the RAM address 1 in the construction of FIG. 11 has been described hereinabove, the same things can be said with respect to all of the 72 addresses from the address 0 to 71. Since it can be easily understood from the description of FIG. 7 that the time of 67.4 $\mu$s is divided into 72 slots and the time division multiplexing operation can be effected with the time of one slot 0.942 $\mu$s, the additional description is omitted for the sake of brevity.

Returning to FIG. 1, the ROM address for the wave ROM6 is calculated by the time division multiplexing operation of the 72 slots which is calculated from the wave ROM address calculator 4 so that the wave data is also obtained in a time division multiplex form of the 72 slots from the wave ROM6. Since the ROM address for the envelope ROM7 is obtained in a time division multiplex form of the 72 slots from the envelope ROM address calculator 5 at a timing which is synchronized with it, the envelope data from the envelope ROM7 is obtained in a time division multiplex form of the 72 slots. Since the wave data is multiplied by the envelope data with a multiplier 8, the wave data with the envelope attached thereto is obtained in a time division multiplex form of the 72 slots, and the output is also provided as tone signals from the speaker 12 through a D/A converter 9, a clock rejection filter 10 and a power amplifier 11.

In the above description, the rise-up and fall-down envelope data of the various amplitudes are stored as the envelope ROM7 as shown in FIG. 9. An embodiment wherein the envelope data of the amplitude of one type is accommodated and the ROM size is rendered smaller will be described hereinafter.

Figure 13:
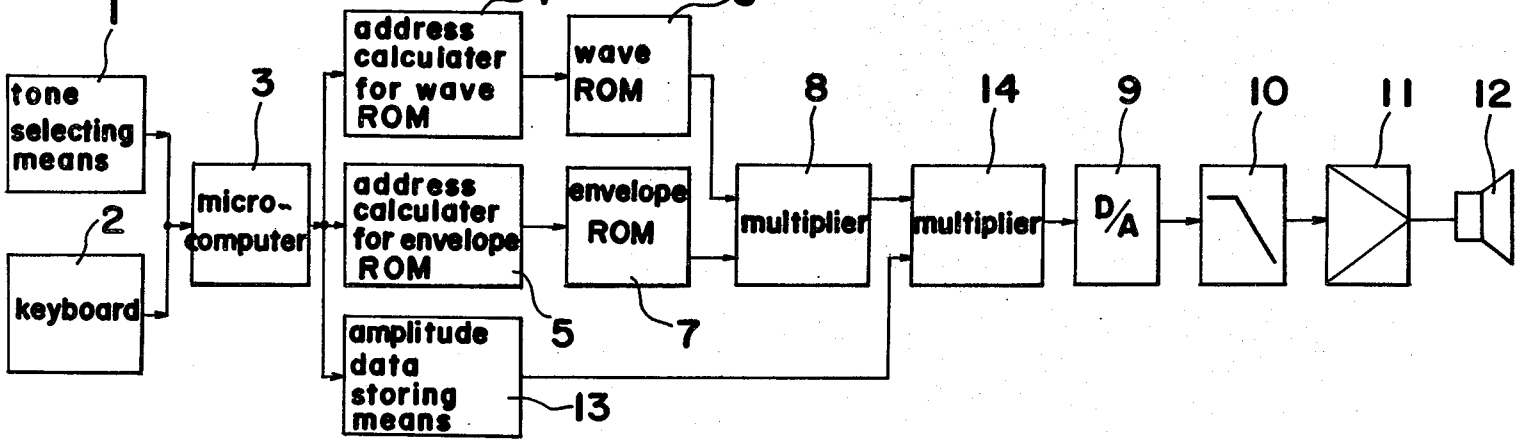
FIG. 13 is a block diagram of an electronic musical instrument in the second embodiment of the present invention.
Figure 14:
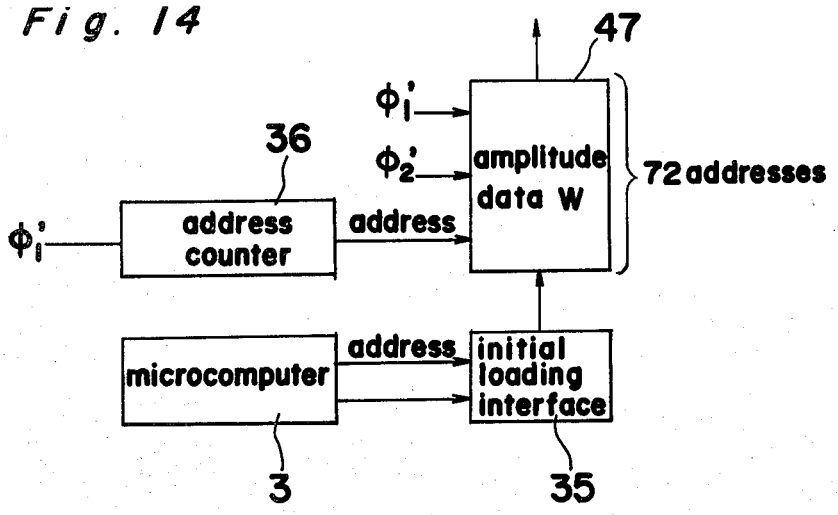
FIG. 14 is a block diagram of the amplitude data storing means of FIG. 13.

FIG. 13 shows the entire system thereof. The difference from the construction of FIG. 1 lies in the addition of the amplitude data storing means 13 and the multiplier 14. Since the amplitude data is obtained with time division multiplexing from the amplitude data storing means 13, only the envelope data of a constant amplitude is stored in the envelope ROM7. As shown in FIG. 14, the RAM47 of 72 addresses where the amplitude data W are stored is provided as the actual construction of the amplitude data storing means. The address counter 36, the microcomputer 2 and the initial loading interface 35 may be the same as those already shown in FIG. 7 and FIG. 11.

When the amplitude data is written in each address, through the initial loading interface 35, from the microcomputer with respect to the wave data RAM47, the address counter sequentially accesses the RAM47 for each counting of the $\phi'_0$ to provide the amplitude data in a time division multiplex form to the output.

The wave ROM6 can also be rendered smaller in size by the addition of additional hardware.

Figure 15:
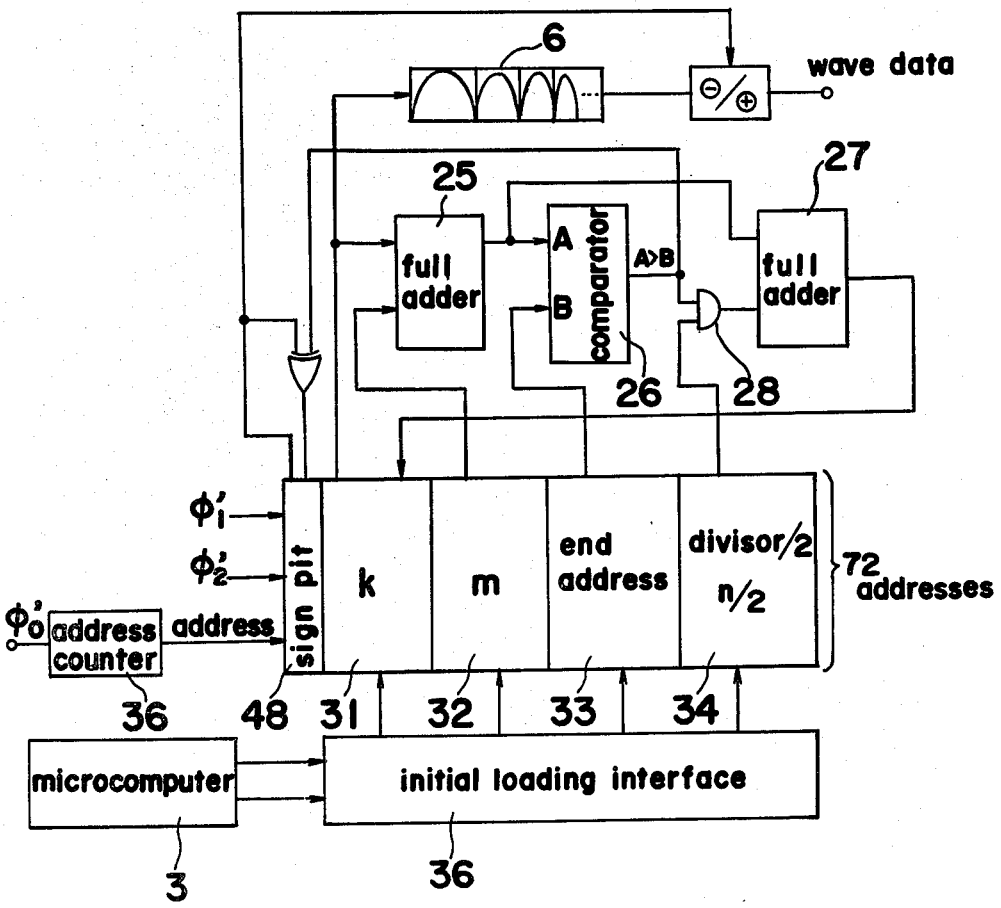
FIG. 15 is a block diagram showing a modification of the wave ROM6 of FIG. 13.
Figure 16:
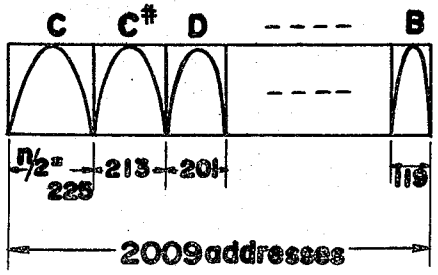
FIG. 16 is a graph showing a set of sine wave curves outputted from the ROM6 of FIG. 13.

One example of the construction of the wave ROM6 will be shown in FIG. 15. As shown in FIG. 16, the wave ROM6 has the one-half-period wave data of the sinusoidal wave stored therein. One bit of sign RAM48 is provided adjacent to the K-RAM31 and the value of $\ominus n/2$ is stored in the RAM34. Since the wave ROM6 is stored by half the wave in such a manner as described hereinabove, the ROM size can be reduced to one half. The size of the wave ROM can be made necessarily smaller in size due to addition of additional hardware even in the one-fourth wave.

Figure 17:
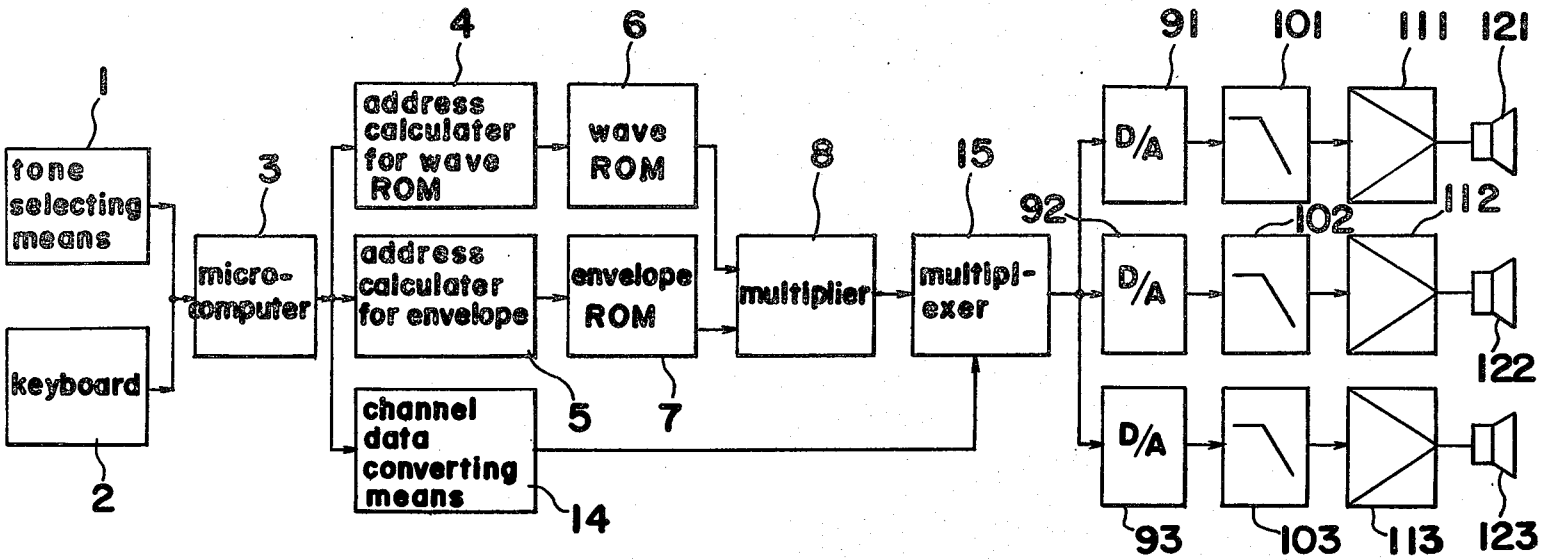
FIG. 17 is a block diagram of an electronic musical instrument in the third embodiment of the present invention.

FIG. 17 shows the three channels of a multichannel system. The D/A converters 91, 92, 93, the clock rejection filters 101, 102, 103, the power amplifiers 111, 112, 113 and the speakers 121, 122, 123 are disposed by three channels. The channel data from the channel data means 14 determines which channel makes sounds. The demultiplexer 15 distributes the tone signal data, to which the envelopes from the multiplier 8 are attached, to a given channel by a channel data. Accordingly, the microcomputer 3 writes in the channel data means 14 a channel to be assigned in each of the 72 slots.

The channel data means 14 is the same in construction as the amplitude data means of FIG. 14.

Some advantages of the embodiment will be enumerated hereinafter.

In the time division multiplex of 72 slots, anything can be assigned to the 72 slots. In the embodiment, the assignment has been performed as shown in Table 3, considering the use as the tone source for the draw-bar application, but the assignment is not restricted. In the extreme, the 72 slots may be assigned to up to the seventy-second harmonics from the fundamental in the use as the tone source of the monotony. Also, since the number of the maximum, simultaneous pronunciations is considered 4 in the use as the accompaniment chord, 18 slots can be assigned per tone and can be assigned from the fundamental to the eighteenth harmonics. In this manner, flexibility is allowed with respect to any tone source.

Secondly, since the sinusoidal wave is read as the wave data, purer and soft tones can be provided than the flute type waves, which have been provided through the filter from the rectangular wave or the corrugated waves as before.

Thirdly, the present system does not require the tone color filter at all as in the conventional system, since the tone color is adapted to be changed by the composition of the sinusoidal wave. The use of the tone color filter not only complicates the system, but also causes undesirable results such as S/N reduction, distortion inducement, etc. In the case of the present system, the D/A conversion allows the direct connection up to the power amplifier without extra work.

Fourthly, the system wherein no wave calculation is performed is one of the characteristics in accordance with the present invention. Assume that the harmonics from the fundamental to the seventy-second are assigned to the 72 slots. According to the conventional method, upon application of the spectrum from the fundamental to the seventy-second harmonics as the tone color data, the sinusoidal wave amplitude of each of the 72 harmonics is multiplied by the respective spectrum amount in accordance with the spectrum. They are added to provide complex waves, which are written in the wave memory. Thereafter, the wave reading is performed for multiplication with the envelope data, and a so-called inverted fourier transform is provided. On the other hand, according to the present system, all the 72 sinusoidal waves will be read with the same amplitude straight without the wave calculation, a given tone color is provided as the multiplication results with the 72 envelope data. The problems involved in the wave calculation are provided as described in the beginning. In the system of the present invention, all these problems can be settled.

Fifthly, the characteristic is that the every-moment tone color can be changed. The 72 slots can control the frequency of the wave independently and can set the envelope of the ADSR independently. Since the every-moment color tone variation means the every moment spectrum variation, assume that the seventy-second harmonics are assigned from the fundamental to the 72 slots, and the attack time is made faster with lower order in harmonics and the attack time is made sufficiently slower with higher order in harmonics so that soft tones which are less in harmonics starts at the beginning of the key depression, and tone which are more in harmonics are provided as time passes. Also, assume that the longer decay time with lower order in harmonics and the shorter decay time with higher order in harmonics, and sharp sounds which are produced when an object has been beaten are caused at the beginning upon depression of the key, and the harmonics decrease immediately after the sharp sounds thereby to leave the soft sounds behind. At this time, the sounds like piano can be simulated. The ADSR of each harmonic envelope is improved to become free from the electric characteristics such as continuous fixed tone-color, which can be often found in the conventional electronic musical instruments.

Sixthly, since the clocks $\phi'_0$, $\phi'_1$, $\phi'_2$ are rendered constant as 0.942 $\mu$s, which is changed for every circuit and is fixed without changes for each note, the system construction is extremely simple. In the case of the embodiment, only the RAM address requires 72 waves or envelopes independently although the 72 waves or envelopes are read independently. Not only the full adder and comparator necessary for calculation, but also the wave ROM, envelope ROM, multiplier, D/A converter, etc. are not disposed by 72. If they are disposed one by one, the employment can be performed by the time division multiplex of 72 slot portions. In the time division multiplex of 72 slots, 72 data portions are normally provided and are sequentially switched by the multiplexer. However, according to the present invention, the RAM of the 72 addresses is used. Thus, the time division multiplexing can be realized freely, by the rotation of the addresses, without the use of the multiplexer. This point is an advantageous point in the system construction of the present invention.

Seventhly, the major system portion of the present invention is all digital. The digital circuit is larger in operation noise margin as compared with an analog circuit. Namely, since all the circuits output 1 and 0 in the power source voltage, all the signals can be handled in the volt range of amplitude. On the other hand, an analog circuit is required to handle the signals in millivolt or microvolt range. Thus, special care is required in design as to the S/N, distortion or ground circuit wiring. In addition, in analog circuits, the problems such as drift, offset or the like are normally required to be taken into consideration during their design. However, in digital circuit, 1 remains 1 strictly and 0 remains 0 strictly unless an unavoidable thing occurs. Since $1+1=2$ and $0\times0=0$, $1+1=2.001$ is not correct and $0\times0=0.001$ is not correct. In digital circuitry, problems such as drift and offset are irrelevant in the normal design.

Eighthly, the characteristic dispersion caused by element variations, or adjustment requirements are removed. For example, the construction of the same instrument as that of the above-described embodiment, using analog circuits requires 72 sinusoidal wave oscillators, 72 envelope generating means and 72 analog multipliers. Speaking about the oscillator, the oscillation amplitude causes variations due to the value of the transistor or RC elements to be used. When necessary, an adjustment may be required. The same things can be said about variations in the 72 envelope generating means and the analog multiplier. On the other hand, in the digital system of the present invention, no variations are caused among the 72 slots so long as the operation is normal, even in the wave data and the envelope data. Accordingly, the many conventional adjusting operations can be eliminated.

Ninthly, advantages are provided for mounting on the electronic musical instrument. Namely, the major portions of the present invention is of a digital construction easier for large scale integration adoption and can be realized with the use of approximately 10,000 transistors as its number of the elements except for the microcomputer. The integrated scale of the current digital LSI can be sufficiently included in 1 chip in terms of 64K bit mask ROM and 16K bit static RAM on the market. The major portions of the electronic musical instrument, even if the microcomputer is contained, can be constructed on one printed circuit base plate, thus resulting in a remarkable progress as compared with the conventional construction using the ten-odd or several tens of printed circuit base plates.

For easier understanding in the above description, concrete numerical values have been used. However, the present invention is not restricted to these numerical values. The wave ROM may be a RAM without any restriction to the ROM.

As described hereinabove, the present invention can realize a tone source system for a superior electronic musical instrument which is suitable for an LSI application, since the wave data can be provided in time division multiplex form, or the envelope data can be provided in a time division multiplex form in a synchronous relationship with it, and the wave data to which the envelopes are attached can be provided in a time division multiplex form through multiplication of the data.

Although the present invention has been described and illustrated in detail, it is to be clearly understood that the same is by way of illustration and example only and is not to be taken by way of limitation, the spirit and scope of the present invention being limited only by the terms of the appended claims.

What is claimed is:

1. An electronic musical instrument having a wave generating means for use in a tone generator having an Inverse Fourier Transformation means, said wave generating means comprising a wave memory for storing a plurality of wave data and an address calculator operatively connected to said wave memory for calculating and supplying an address value to said wave memory, wherein a plurality of wave data is supplied as a time division multiplexed output from said wave memory; wherein said address calculator comprises an arithmetic logic circuit and a random access read/write memory having a plurality of addresses, and wherein said random access read/write memory stores a plurality of groups of data, each of which including values corresponding to an octave and number of harmonics of a tone wave and necessary for calculation of said address values of said wave memory, and wherein one group of data is sequentially read out and supplied to said arithmetic logic circuit, said address value then being calculated and supplied to said wave memory in a time division multiplexed form and said wave memory being arranged to output tone data in a time division multiplexed form.

2. An electronic musical instrument having an envelope generating means, used in a tone generator using an Inverse Fourier Transformation means and having envelope data and wave data contained therein, wherein the envelope generating means comprises an envelope memory and an address calculator for said envelope memory, and having means arranged such that said envelope data is directly multiplied by said wave data for obtaining a plurality of tone signals which have been transformed by an Inverse Fourier Transformation and is stored in said envelope memory, and wherein a time division multiplexed address value which is calculated by said address calculator for the envelope memory is supplied to said envelope memory, and a plurality of time division multiplexed envelope data is output from said envelope memory; wherein said address calculator comprises an arithmetic logic circuit and a random access read/write memory having a plurality of addresses, a group of data which is necessary for the calculation of said address value of said envelope memory being stored in each one address of said random access read/write memory, from which said one group of data are sequentially read out and supplied to said arithmetic logic circuit, by which said address value of said envelope memory is calculated every time and is supplied to said envelope memory in a time division multiplexed form so that a plurality of the envelope data may be obtained utilizing time division multiplexing from said envelope memory.

* * * * *